US005257421A

United States Patent [19]

Rose et al.

[11] Patent Number: 5,257,421

[45] Date of Patent: Nov. 2, 1993

[54] AIR FRESH TOILET

[75] Inventors: Lance T. Rose, 4950 E. Allen Ave., Flagstaff, Ariz. 86004; Eugene T. Zimmerman, Sedona, Ariz.

[73] Assignee: Lance T. Rose, Flagstaff, Ariz.

[21] Appl. No.: 888,896

[22] Filed: May 26, 1992

[51] Int. Cl.[5] ..... E03D 9/052

[52] U.S. Cl. ..... 4/214; 4/209 R

[58] Field of Search ..... 4/214, 216

[56] References Cited

U.S. PATENT DOCUMENTS

| | | | |
|---|---|---|---|
| 1,276,965 | 8/1918 | Rowe | 4/214 |
| 1,520,554 | 12/1924 | Ankeny et al. | 2/214 |
| 2,677,830 | 5/1954 | Allen et al. | 2/214 |
| 3,703,010 | 11/1972 | Russell | 4/216 |
| 4,133,060 | 1/1979 | Webb | 4/216 |
| 4,222,129 | 9/1980 | Baker | 4/216 |
| 4,365,361 | 12/1982 | Sanstrom | 4/216 |
| 5,044,018 | 9/1991 | Gandini | 4/216 |

FOREIGN PATENT DOCUMENTS

| | | | |
|---|---|---|---|
| 1147836 | 4/1956 | France | 4/214 |
| 20727 | 2/1898 | Ireland | 4/214 |

*Primary Examiner*—Henry J. Recla
*Assistant Examiner*—Charles R. Eloshway

[57] ABSTRACT

Odors associated with the use of toilets are reduced by providing a water driven positive ventilation fan which pumps undesirable odor bearing gases from the toilet bowl and discharges them into the sewer through an auxiliary passage built into the toilet base. Operation of the ventilated toilet is automatic. Water valves coupled to the toilet seat and lid hinges turn on the fan's water turbine when the lid is raised and weight placed on the seat. The fan turbine shuts off automatically when this condition is no longer satisfied. An automatic blocking valve is provided in the auxiliary passage to prevent back-streaming of sewer gas. This gas blocking valve opens automatically when the fan is in operation and closes when the fan shuts off. No electrical connections are required.

18 Claims, 5 Drawing Sheets

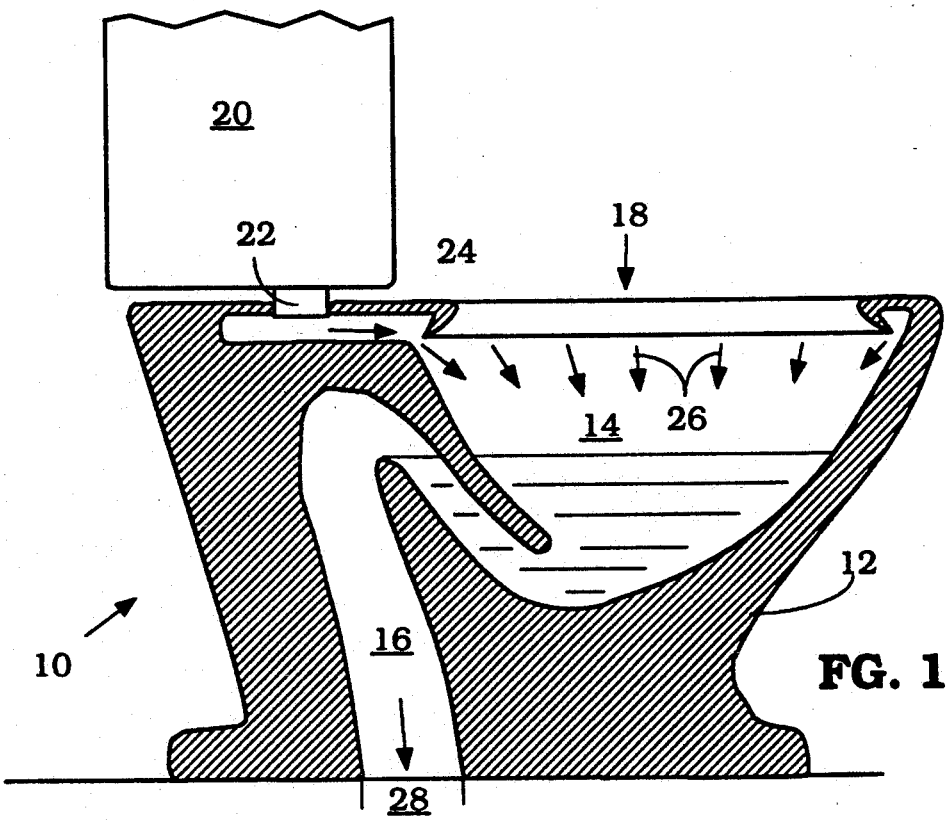
FG. 1
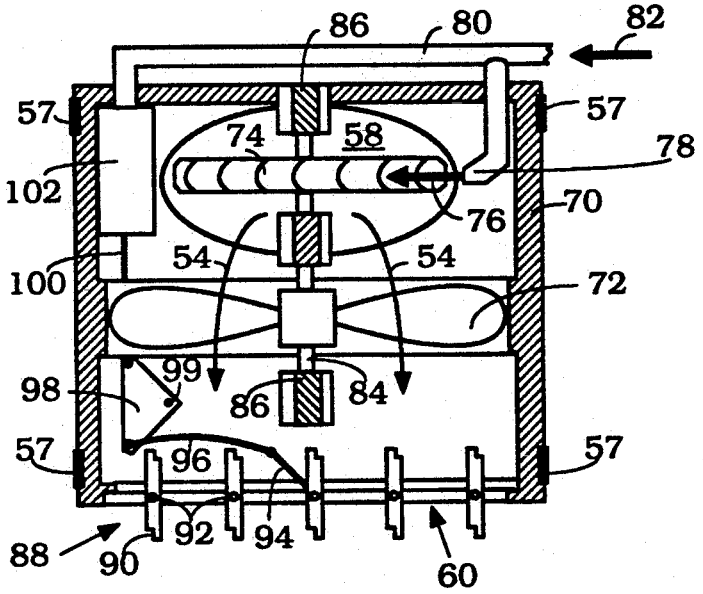
FIG. 4
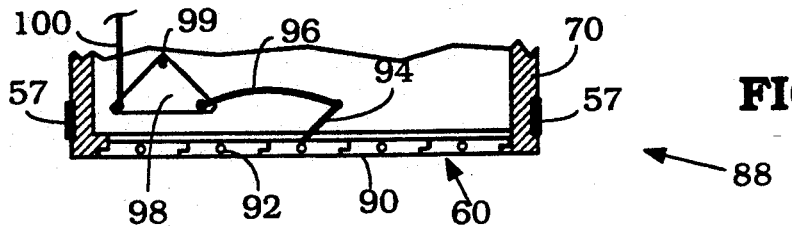
FIG. 5

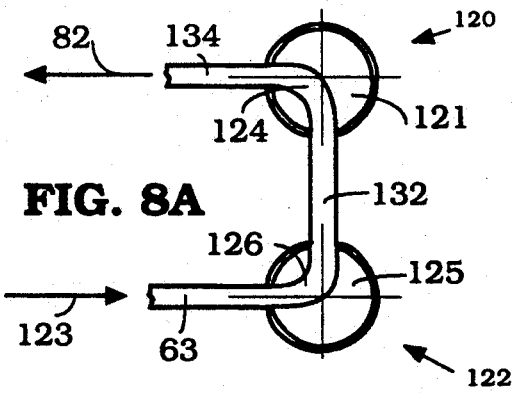
FIG. 8A
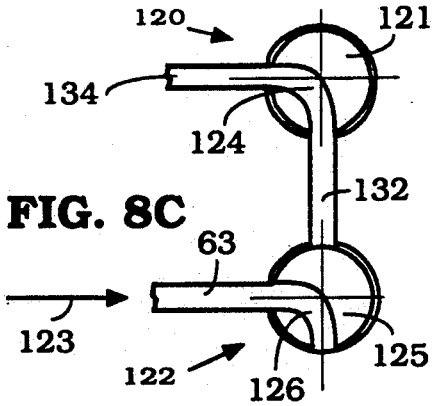
FIG. 8C
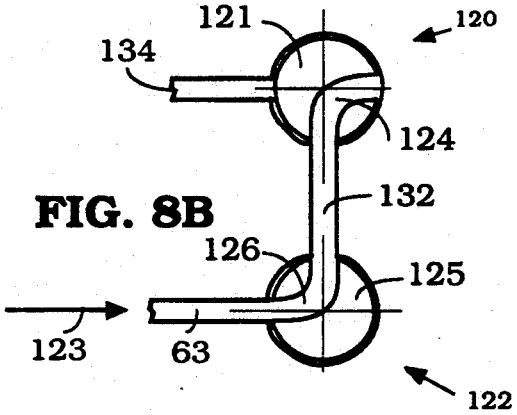
FIG. 8B
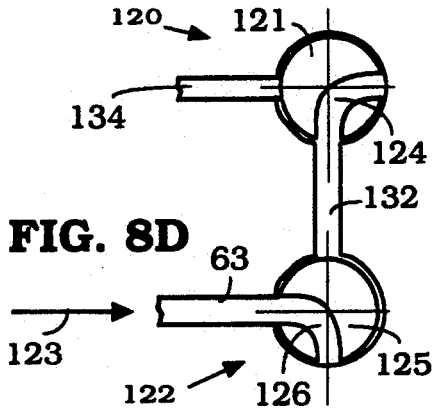
FIG. 8D
FIG. 6
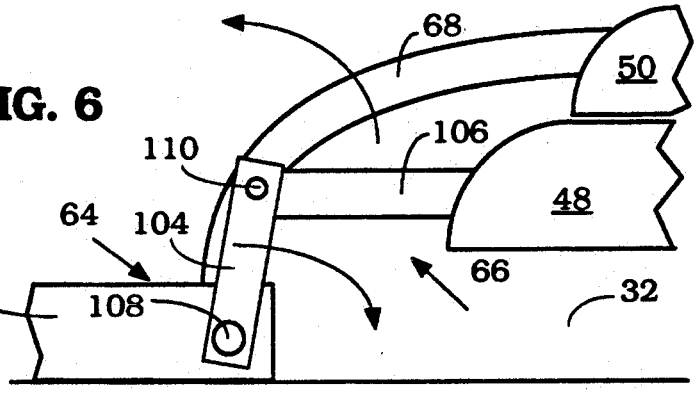
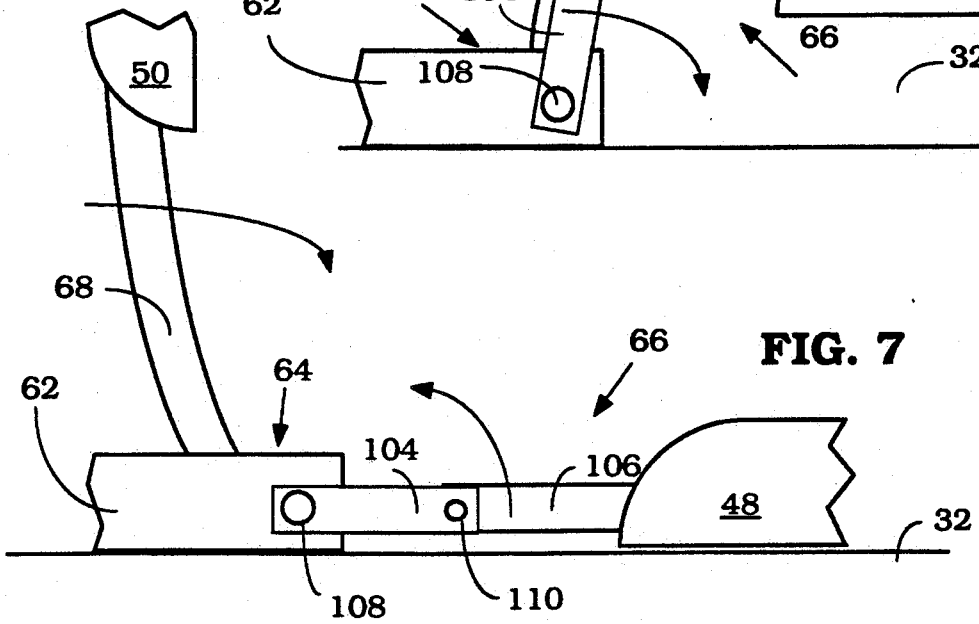
FIG. 7

AIR FRESH TOILET

FIELD OF THE INVENTION

This invention relates to toilets and, more particularly, toilets that provide for removal of odor generated in connection with use thereof.

BACKGROUND OF THE INVENTION

Controlling odors in restrooms intended for disposal of human waste is a long standing problem that has been approached in numerous ways. For example, it is common to provide exhaust fans to continually or periodically remove odor containing air from the restroom for disposal out of doors where the odors will be dissipated. Another common method is to cover up the odors by providing a powerful but pleasant scent which, because of its strength, overcomes and masks the unpleasant waste disposal odors. As those of skill in the art appreciate both of these approaches involve dealing with the entire air volume of the room rather than with the immediate source of odors, which are most typically the toilets in the rest room.

A third approach which has been described in the prior art is to provide for ventilation of the toilets themselves. For example, in U.S. Pat. No. 3,703,010 to Russell describes a ventilated toilet in which there is provided a electric fan motor which exhausts air from within the toilet bowl when the toilet is flushed and discharges it into the sewer vent stack. In U.S. Pat. No. 4,133,060 to Webb describes an odorless toilet in which vents are provided around the periphery of the toilet directly below the toilet seat, and an electric fan is provided built into the toilet to suck odor bearing gases through these vents and force them into the sewer outlet of the toilet remote from the bathroom interior. In U.S. Pat. No. 4,222,129 to Baker describes an odor removal toilet using an electrically driven fan for exhausting odor gases from the toilet bowl, in combination with a hydraulic pump driven by the same electric motor. In U.S. Pat. No. 4,365,361 to Sanstrom describes a toilet bowl eductor system in which an electrically driven suction fan pulls odor gases from between the toilet bowl and seat and injects it into the sewer through an auxiliary base plate between the toilet and the floor. These approaches all suffer from the limitation of requiring an electrical connection to the toilet and associate exhaust fan motor.

Hence, there continues to be a need for improved odor removing toilets which overcome some or all of the deficiencies or limitations of the prior art.

SUMMARY OF THE INVENTION

There is provided an odor removing toilet comprising, most generally, a bowl for receiving and (when the toilet is flushed) discharging wastes to a sewer connection through a first passageway, a water driven motor, a water supply for providing water to discharge the wastes and for actuating the water motor, and a fan actuated by the water motor for removing odor bearing gases from the bowl and directing the odor bearing gases toward the sewer connection.

In more detail, a valve actuated by use of the toilet is desirably provided for directing water from the water source to drive the water motor. The water motor is preferably a water turbine motor.

In a preferred embodiment, the fan is located in a second passageway extending from an upper portion of the bowl to the sewer connection, the second passageway being separate from the first passageway. It is further desirable to provide a valve in the second passage for blocking sewer gases when the toilet is not in use.

When the toilet is used, the gas blocking valve is opened and water is supplied to the water motor to actuate the fan to draw odor bearing gases from the toilet bowl and deliver them to the sewer connection. When use of the toilet is complete, the gas blocking valve closes to prevent sewer gases from re-entering the toilet through the second passageway and the water driving the turbine is cut off.

The present invention will be more fully understood by considering the accompanying figures together with the explanation thereof which follows.

BRIEF DESCRIPTION OF THE DRAWINGS

FIG. 1 is a partial cut-away and cross-sectional side view of a conventional toilet according to the prior art;

FIG. 4 is a partially cut-away and cross-sectional view of the water driven toilet ventilating fan unit such as shown in FIG. 2 but somewhat enlarged and in greater detail;

FIG. 5 is a view similar to the lower portion of FIG. 4 showing an integral sewer gas back-streaming prevention valve in the closed position;

FIGS. 6 and 7 show further details of a two stage water valve actuated by the toilet seat and lid hinge mechanisms, according to a first embodiment of the present invention;

FIGS. 8A–D show schematically the operation of the two stage water valve when the toilet seat and lid are in different positions;

DETAILED DESCRIPTION OF THE FIGURES

Figure 3:
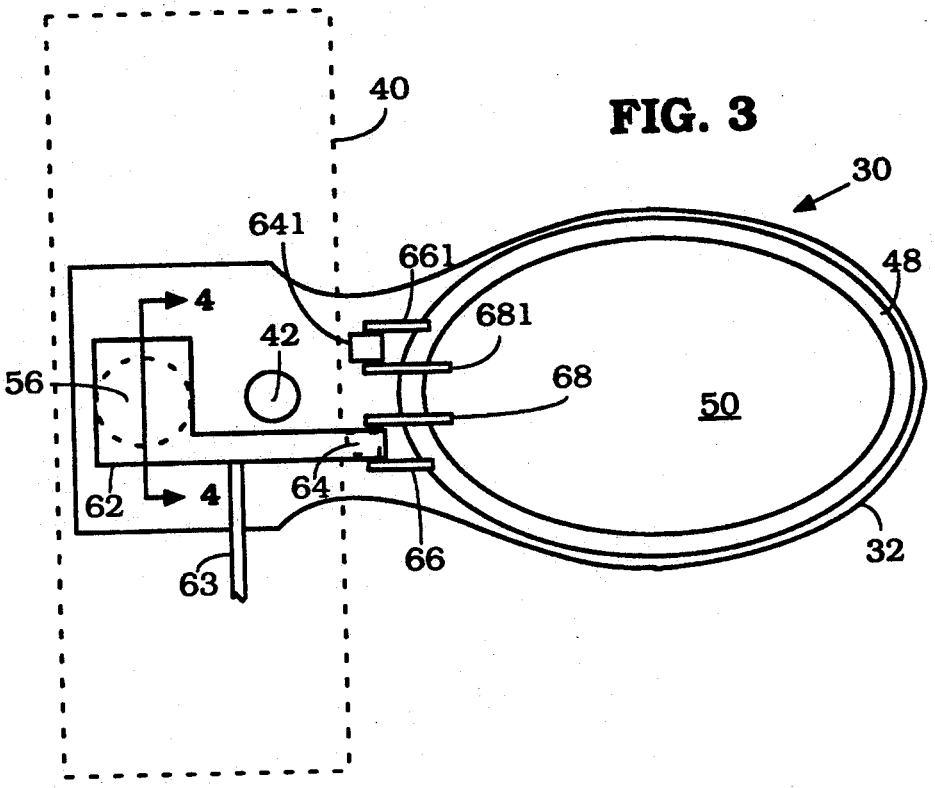
FIG. 3 is a simplified top view of the toilet of FIG. 2.

FIG. 1 is a partial cut-away and cross-sectional side view of conventional toilet 10 according to the prior art. Toilet 10 has base 12 with water filled bowl region 14 and waste channel 16. Waste enters toilet bowl 14 through opening 18. Tank 20 provides water through inlet pipe 22 and lateral channel 24 as indicated by arrows 26 to flush the waste from bowl 14 through waste channel 16 into sewer connection 28. Operation of toilet 10 is conventional. Other water channels between water inlet 22 and bowl 14 sometimes found in prior art toilets to accelerate the flushing action have been omitted for simplicity.

Figure 2:
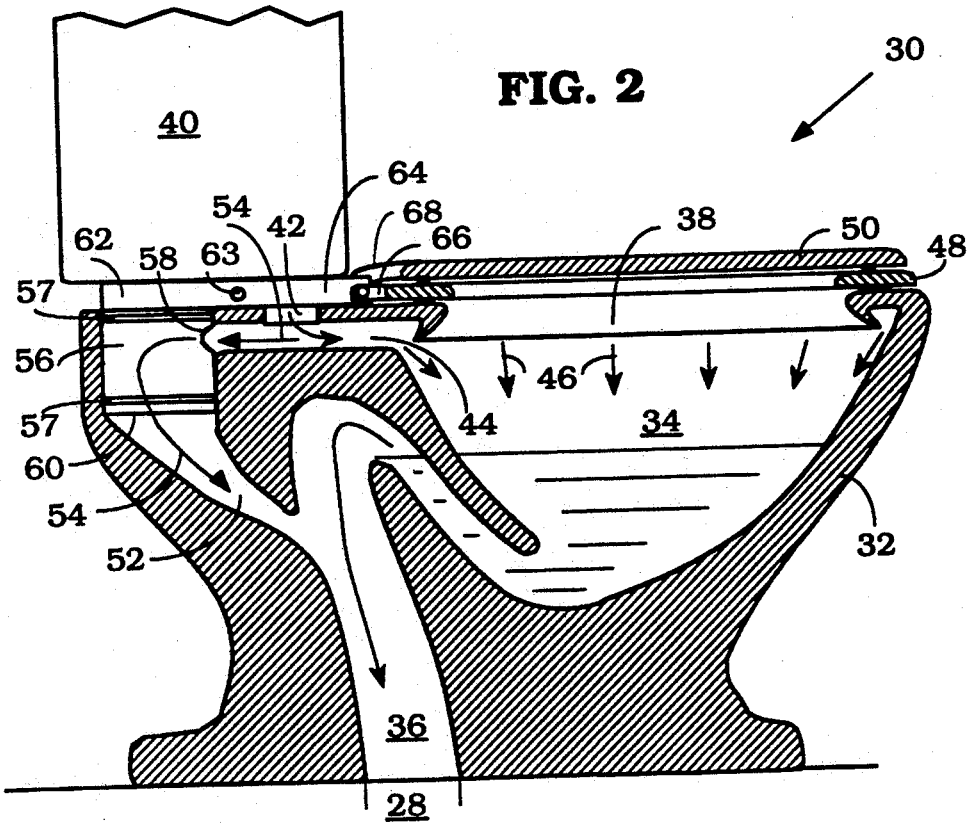
FIG. 2 is a view similar to FIG. 1 but of an improved toilet including a water driven toilet ventilating fan unit according to a first embodiment of the present invention.

FIG. 2 is a view similar to FIG. 1 of improved ventilated toilet 30 according to the present invention. FIG. 3 is a top view of the toilet of FIG. 2 and the general construction is more easily understood by viewing both figures at the same time.

Toilet 30 comprises base 32 having bowl 34 and waste channel 36. Waste enters bowl 34 through opening 38 in substantially the same fashion as for toilet 10. Tank 40 provides water for flushing in substantially the same manner as for tank 20. Water from tank 40 enters base 32 through inlet pipe 42 and lateral channel 44 as indicated by arrows 46. Toilet seat 48 and toilet lid 50 are also shown in cross-section in the conventional closed position. In FIG. 3, tank 40 is shown dashed so as not to obscure underlying details.

Toilet base 32 has gas channel 52 communicating between bowl 34 and waste drain 36 via inlet water channel 44. Gases 54 associated with use of toilet 32 are drawn from the vicinity of bowl 34 through channels 44 and 52 and discharged into waste drain channel 36 and sewer connection 28. Gases 54 are propelled from bowl 34 to channels 52 and 36 by means of hydraulically driven fan unit 56 which is preferably mounted in base 32. Fan unit 56 desirably has gaskets 57 which prevent significant sewer gas leakage around fan unit 56. Fan unit 56 has inlet 58 from channel 44 through which gases from bowl 34 enter and discharge 60 leading to channel 52.

Valve assembly 62 having water inlet 63 provides water to drive fan unit 56. Water inlet 63 is conveniently coupled to the same water supply (not shown) that provides water to tank 40, as for example, the standard cold water supply line. Valve assembly 62 conveniently has water valve 64 therein (see also FIGS. 6–8) which control the supply of water to drive hydraulic fan unit 56. Water valve 64 in valve assembly 62 is conveniently controlled by hinge brackets 66 and 68 coupled, respectively, to toilet seat 48 and toilet lid 50. Matching hinge brackets 661, 681 are coupled to mechanical hinge mount 641. This allows the toilet seat and lid to open and close in a conventional fashion while at the same time providing for actuation of valve 64 as is explained in more detail in connection with FIGS. 6–8 and 14–15. While valve assembly 62 and valve 64 are shown in FIGS. 2–3 as being mounted above base 32 and extending under tank 40, this is not essential, and assembly 62 and valve 64 maybe located in any convenient position.

FIG. 4 is a partially cut-away and cross-sectional view along direction 4—4 of FIG. 3, of water driven toilet ventilating fan unit 56 but somewhat enlarged and in greater detail. Fan unit 56 has inlet 58 and discharge 60 and, desirably but not essentially, sealing gaskets 57 mounted in exterior body 70. As indicated by arrows 54, air enters at inlet 58 under the action of fan 72 and is propelled toward discharge 60. Fan 72 is conveniently driven by water turbine 74 under the action of water jet 76 from nozzle 78. Nozzle 78 is connected to water supply line 80 carrying water flow 82 from valve 64. Water turbine 74 is conveniently a small bucket turbine driven by water jet 76, but any form of water motor of an appropriate size and power will also serve. Since water turbine 74 is only required to drive fan impeller 72, a great deal of power is not required.

Water turbine 74 and fan impeller 72 are conveniently mounted on common shaft 84 supported by bearings 86 centrally located within housing 70 by means of struts (not shown). The struts project from the interior walls of housing 70 toward the center of housing 70 so that shaft 84 is approximately vertically oriented, conveniently about in the center of housing 70 as viewed from the top, but this is not essential. The water used to drive turbine 74 falls through housing 70 and outlet 60 into channel 52 and drains away into sewer connection 28 (see FIG. 2). In the arrangement depicted in FIG. 4, water turbine 74 is shown as being located above fan impeller 72, so that the water discharged from turbine 74 falls through fan impeller 72, but this is not essential. Turbine 74 may be located below fan impeller 72 in which case the water discharged from the turbine then does not fall through fan impeller 72.

Fan unit 56 is conveniently provided with automatic gas valve 88 which is closed when fan 56 is not operating. The purpose of gas valve 88 is to prevent sewer gas from back-streaming into toilet bowl 34 and from there into the surrounding atmosphere when fan 56 is not operating. When fan 56 is operating the positive pressure created by fan impeller 72 prevents any back-streaming and there is a net discharge of noxious vapors from toilet bowl 34 into sewer connection 28.

Anti back-steaming gas valve 88 conveniently comprises shutter-like doors 90 which pivot on shafts 92 in response to the movement of shutter control lever 94 actuated by link 96 and pivoting corner plate 98 rotating around pivot point 99 under the influence of push-pull rod 100 driven by water piston 102. Shutter doors 90 are linked together in the conventional manner so that movement of lever 94 causes all of the individual doors to rotate at the same time. Housing 70 is conveniently of a size and shape (e.g. oval, rectangular, etc.) so as to provide space outside the perimeter of fan blades 72 so that shaft 100 may extend past fan blades 72. Housing 70 conveniently has a rectangular shape (viewed looking along shaft 84) with a circular central region surrounding fan blades 72 and a small by-pass channel in a corner outside the perimeter of blades 72 to accommodate push-pull rod 100, but other arrangements will also serve.

FIG. 4 shows the configuration of gas valve 88 when in the open position and FIG. 5 shows the arrangement of gas valve 88 and its associated linkages when in the closed position. Water piston 102 is arranged so that in the absence of water 82 in pipe 80, shaft 100 is in its extended position, corner plate 98 is rotated into the position shown in FIG. 5 and doors 90 are closed as shown in FIG. 5. When water 82 enters water inlet pipe 80, water piston 102 lifts shaft 100, rotating corner plate 98 and pulling linkage 96 and lever 94 to the left, causing shutter blades 90 to rotate counter-clockwise into the open position shown in FIG. 4. When water 82 is shut off (by valve 64) then shaft 100 drops back by gravity or a spring (not shown) into its extended position, thereby automatically closing shutter doors 90 of gas valve 88. Thus, gas valve 88 has the feature of automatically closing when the toilet is not in use and fan 56 is not running. This is a particular feature of the present invention. However, as those of skill in the art will understand based on the description herein, other means for opening and closing gas valve 88 may also be used.

The operation of valve 64 to control the action of fan unit 56 and gas valve 88 are more easily understood by consideration of FIGS. 6–8. FIGS. 6–7 show the portion of valve assembly 62 containing valve 64 adjacent toilet seat 48 and toilet lid 50, in different positions. Hinge bracket 66, 68 connect valve 64 to the toilet seat and lid, respectively. Hinge bracket 66 desirably has two portions, portion 106 connected to toilet seat 48 and portion 104 connected to shaft 108 of valve 64. Portions 104, 106 are coupled by rotating pin 110. Hinge bracket 68 couples toilet lid 50 to another portion of valve 64 (located behind bracket 104 and shaft 108 in FIGS. 6–7) which conveniently rotates independently but around the same axis as shaft 108.

FIG. 6 shows the arrangement of hinge brackets 68 and 104, 106 when the toilet lid is closed and the toilet is not in use. It will be noted that bracket 104 has a spring bias (not shown) which maintains it approximately in an upright position when there is substantially no weight on toilet seat 48, i.e., the toilet is not being used. The weight of lid 50 is insufficient to significantly disturb bracket 104 and shaft 108 from the position shown in FIG. 6 when the toilet is not in use.

FIG. 7 shows the situation when the toilet is in use. Lid 50 is raised so that hinge bracket 68 is rotated approximately ninety degrees counter-clockwise compared to the position in FIG. 6, and the weight of the user of toilet 30 causes hinge bracket 104 to rotate clockwise by approximately ninety degrees into the position shown in FIG. 7. It is the rotation of shaft 108 attached to bracket 104 and the rotation of the corresponding shaft (not shown in FIGS. 6–7) attached to bracket 68 that conveniently actuates valve 64.

The action of valve 64 is shown schematically in FIGS. 8A–D. Valve 64 is conveniently a two stage valve, that is, two valves 120, 122 coupled in series, where the presence or flow of water from the combined valves depends on the settings of both valves 120, 122. FIGS. 8A–D are schematic diagrams of the water flow for different settings of, for example, rotary valves. For example, there is provided rotary valve 120 having rotating shaft or ball 121 with approximately right angle channel 124 therein, and rotary valve 122 having rotating shaft or ball 125 with approximately right angle channel 126 therein. Those of skill in the art will understand that shafts or balls 121, 125 rotate around centerlines normal to the plane of the drawings of FIGS. 8A–D. Water inlet pipe 63 (see FIG. 2) carrying inlet water 123 leads to the inlet side of valve 122, line 132 couples from the outlet of valve 122 to the inlet of valve 120 and pipe 134 couples to the outlet of valve 120. When water is flowing through both valves (as in FIG. 8A), then water stream 82 is delivered from outlet 134 and actuates fan unit 56 and gave valve 88 as shown in FIG. 4.

Two stage valve 64 is arranged so that the situation of FIG. 8A is what is obtained when seat 48 and lid 50 are in the positions shown in FIG. 7, i.e., lid up and weight on the seat (toilet in use). FIGS. 8B and 8C correspond to the situation when one or the other of seat 48 or lid 50 is in the incorrect position, i.e., lid up but no weight on the seat (toilet open but unused) or lid down and weight on the seat (using the toilet as a chair). FIG. 8D corresponds to the situation shown in FIG. 6 when the lid is down and there is no weight on the seat (toilet inactive and closed). Those of skill in the art will understand based on the description herein that any combination of valves and valve settings that provides water flow when the lid is up and the seat in the down and used (weight on the seat), but not otherwise, will also serve. Those of skill in the art will also understand that although rotary valves are illustrated for purposes of explanation, sliding valves, e.g., like a trumpet valve will also serve. For example, rotation of the lid and/or seat may turn a pinion which engages a rack or turn a crank attached to a connecting rod. The rack or connecting rod are coupled to a sliding valve so that movement of the lid and/or seat moves the sliding valve from one position to another, thereby turning on the water when the relative position of the lid and seat are as described above (i.e., lid up and seat down with weight thereon).

Figure 9:
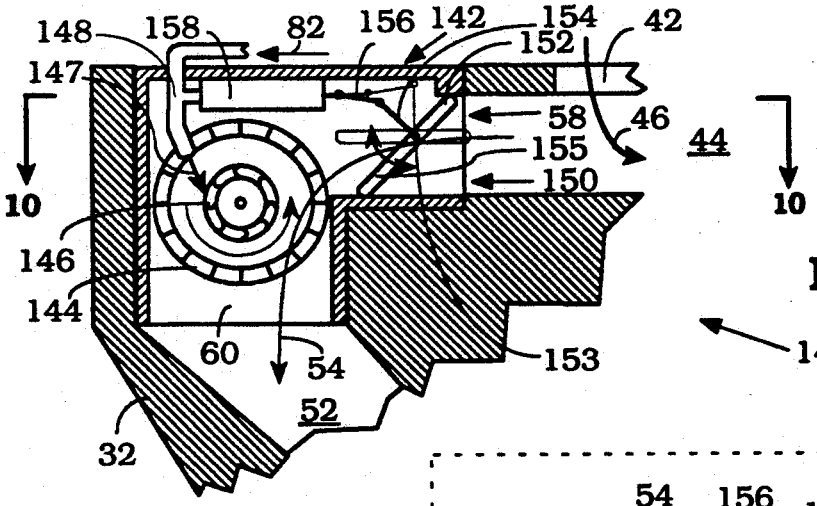
FIG. 9 shows a partial cut-away and cross-sectional side view of a toilet ventilating fan unit according another embodiment of the present invention.
Figure 10:
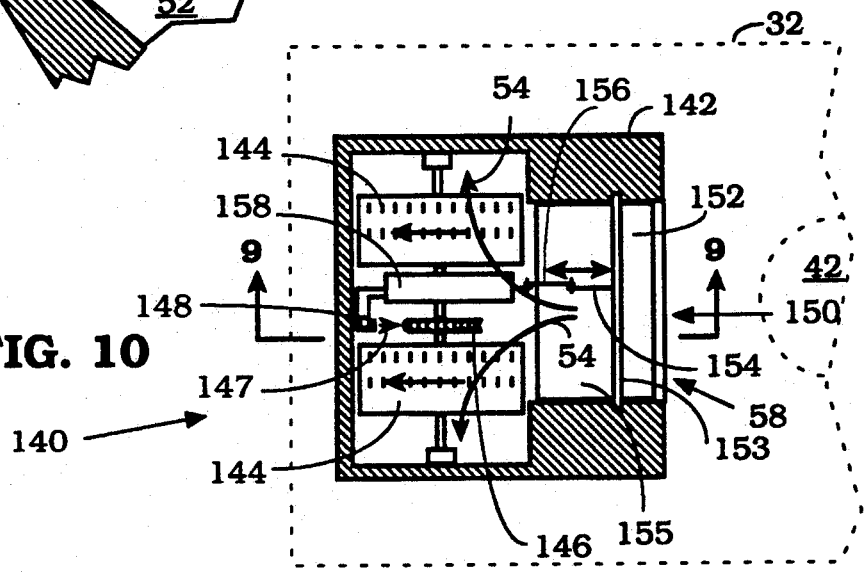
FIG. 10 shows a partial cut-away and cross-sectional top view of the fan unit of FIG. 9.

FIG. 9 shows a partial cut-away and cross-sectional side view of toilet ventilating fan unit 140 according another embodiment of the present invention, FIG. 10 shows a partial cut-away and cross-sectional top view of the fan unit of FIG. 9. Fan unit 140 is installed in base 32, in a manner similar to unit 56. Fan unit 140 has housing 142 containing in this embodiment squirrel cage fan rotor 144 mounted approximately horizontally in housing 142 and driven by water turbine 146 actuated by water stream 147 from nozzle 148. For convenience, two squirrel cage rotors are provided (see FIG. 10) but this is not essential.

Gases from toilet bowl 34 are drawn into inlet 58 of fan unit 140 and under the influence of squirrel cage rotor 144 and delivered to outlet 60. FIGS. 9–10 illustrate an arrangement wherein sewer gas anti-back-streaming valve 150 is placed near inlet 58 between the fan and the toilet bowl, rather than near outlet 60. Valve 150 comprises rotating flapper valve 152 which pivots around shaft 153 under the action of lever 154, push-pull rod 156 and hydraulic piston 158. Axle or pivot 153 is desirably not located in the center of flapper valve 152, so that when no water is being supplied to piston 158, the weight of portion 155 of valve 152 is sufficient to cause valve 152 to rotate into the closed position, as shown by the heavy lines in FIG. 9 (the open position is shown by light lines). The operation of valve 140 is much like that of valve 56, that is, when water 82 is supplied, piston 158 opens gas valve 152 and jet 147 rotates turbine 146 thereby spinning fan rotor 144 so that gases 54 are pulled from bowl 34 through inlet 58 and discharged through outlet 60 into channel 52. When water 82 is shut off, gas valve 152 falls shut or is closed by a spring (not shown) and turbine 146 and fan 144 stop. The operation of fan unit 140 is determined by the positions of valve 64 as previously discussed. While fan unit 140 is shown as having water supply 82 introduced from the top, this is not intended to be limiting, and water supply 82 may be provided from any directions. For example, water supply 82 may enter unit 140 from the side, rear, front or bottom as well as the top, so long as it is coupled to piston 158 and turbine 146 so as to provide the actuation described above.

Figure 12:
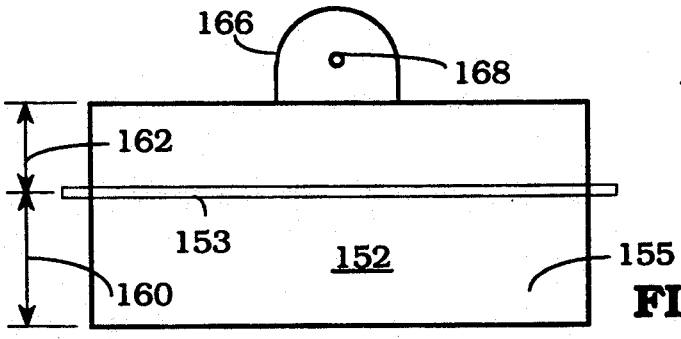
FIG. 12 shows a simplified top view of the valve of FIG. 11.
Figure 11:
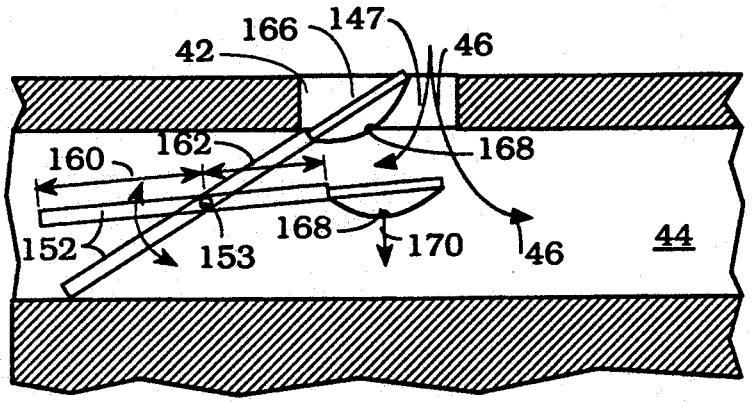
FIG. 11 shows a partial cut-away and side cross-sectional view of a sewer gas back-streaming prevention valve according to a further embodiment of the present invention.

An alternative arrangement for gas valve 152 is illustrated in FIG. 11 which is a partial cut-away and side cross-sectional view of a sewer gas back-streaming prevention valve, according to a further embodiment of the present invention. FIG. 12 shows a simplified top view of the valve flapper of FIG. 11. The difference in distance 160 compared to distance 162 of the location of pivot shaft 153 with respect to the balance point of valve 152 is illustrated, that is, distance 160 desirably exceeds distance 162 by an amount sufficient to automatically close valve 152 by gravity.

An additional tab or small scoop 166 is provided on the inlet edge of gas valve 152. Tab or scoop 166 is arranged to extend into or underneath water inlet 42 leading from water storage tank 40. Valve 152 is biased by gravity to remain in the closed position when the toilet is not in use. When the toilet is flushed, water 46 rushes from tank 40 through inlet 42 into channel 44 and on into bowl 34 (see FIG. 2). Water 46 strikes tab or scoop 166, flipping valve 152 into the open, approximately horizontal, position, as shown in FIG. 11. A rotation stop (not shown) associated with axle or pivot 153 conveniently stops valve 152 in the approximately horizontal position. By having valve 152 stop at slightly less than horizontal position, portion 47 of water stream passing through opening 42 from tank 40 into channel 44 is deflected toward gas inlet 58 of fan unit 140, thereby flushing the fan unit and associated passageway. This is desirable in order to prevent build-up of mold or other odor causing material in the odor removal mechanism and channel.

It is desirable that tab or scoop 166 have a bowl-like shape so that some of water 46 is captured in scoop 166, thereby adding enough weight to hold valve 152 open as long as the captured water remains in scoop 166. Small hole 168 is provided in the bottom of scoop 166 to allow captured water 170 to slowly drain away. The captured water can be used to hold valve 152 open for a sufficient time to permit the undesirable gases to be removed from bowl 34 without the need for a hydraulic pistons such as is illustrated in the embodiments of FIGS. 4–5 and 9–10. When water 170 has drained away, valve 152 automatically closes by gravity.

Figure 13:
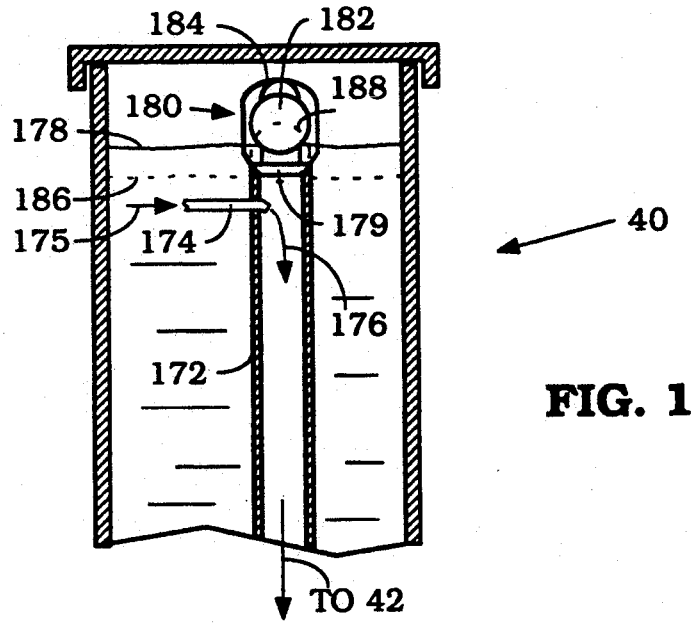
FIG. 13 shows a simplified partially cut-away and cross-sectional view of an automatic air valve provided on a conventional toilet tank stand pipe, according to the present invention.

FIG. 13 shows a partial cut-away and cross-sectional view (looking from the side) of a portion of toilet tank 40, showing stand-pipe 172 having water stream 174. Water supply 175 is provided to water inlet 174 when the toilet is flushed so that water stream 176 flows down standpipe 172 toward opening 42 into water channel 44 of toilet 30 (see FIGS. 2–3). This is the conventional bowl refill arrangement that refills bowl 34 of toilet 30 after the flush has occurred. Stand pipe 172 also provides an emergency drain in case the water shut-off valve (not shown) that refills tank 40 fails to close. If the water in tank 140 reaches level 178 above upper opening 179 of stand pipe 172, it flows harmlessly into toilet 30.

Stand pipe 172 differs from a conventional stand pipe by having at its upper end, air valve 180 which conveniently comprises hollow ball 182 retained within cage 184. When the water in tank 40 is at level 178, ball 182 floats. When the water in tank 40 is at level 186 or below, ball 182 drops to position 188 on top 179 of stand pipe 172, thereby sealing it. This is the normal position of ball 182, i.e., anytime except for an overfill condition such as water level 178. Thus, ball 182 provides a normal gas seal at the top of stand pipe 172. In this way, there is no air entering channel 44 through opening 42 when fan 56, 140 is operating, and the entire suction of fan 56, 140 is available to remove odors from toilet bowl 34.

Figure 14:
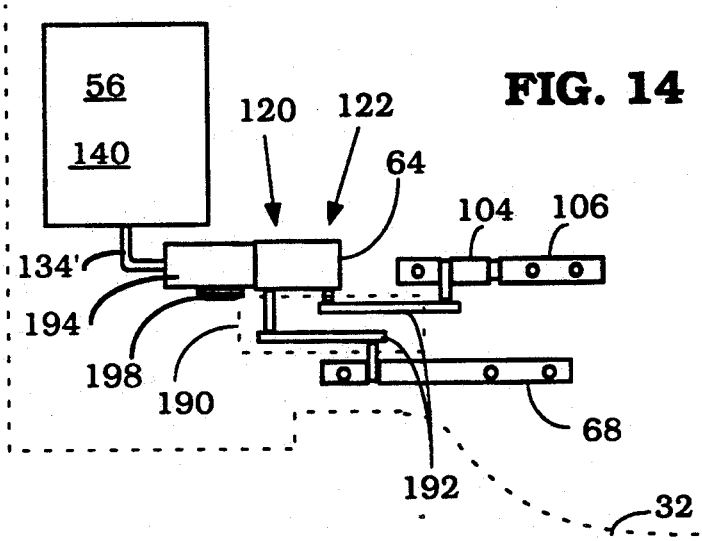
FIG. 14 shows a simplified top view of a two stage water valve and hinge seat actuation mechanism, according to a further embodiment of the present invention.
Figure 15:
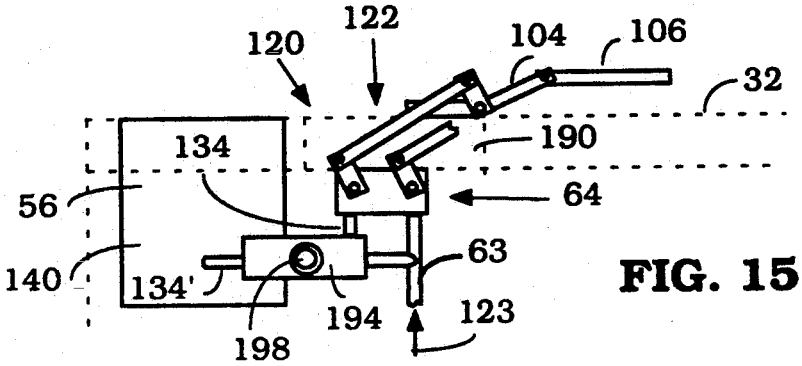
FIG. 15 shows a simplified side view of the mechanism of FIG. 15.

FIG. 14 is a highly simplified top view and FIG. 15 a highly simplified view of water valve 64 actuation mechanism according to another embodiment of the present invention. Water valve 64 comprises two stages valves 120, 122 and has the function previously described of providing water supply 82 to actuate the fan motor and open/close sewer gas back-streaming prevention valve 88, 152. Lid hinge 68 and seat hinge 66 are coupled by levers and cranks to valves 120, 122 of two stage valve 64 so as to provide the combination of valve positions shown in FIGS. 8A–D as the lid and seat assume different positions. (Lid hinge 68 is omitted in FIG. 15 for clarity.)

The arrangement of FIGS. 14–15 differs in several respects from that described in connection with FIGS. 6–7. First, by coupling the lid and seat hinge motion to valves 120, 122 by levers and cranks rather than having rotating valve shafts 121, 125 be coaxial with the hinge pins, as in FIGS. 6–7, greater flexibility is obtained for positioning valve 64. For example, in FIGS. 14–15, valve 64 is shown as being mounted below the lip of toilet base 32. Opening 190 is conveniently provided through the lip of toilet base 32 to allow passage of the valve cranks.

Second, in this embodiment, outlet 134 of valve 120 does not run directly to fan unit 56, 140, but instead actuates auxiliary valve 194. Auxiliary valve 194 is turned on and off by two stage valve 64. Valve 194 couples water supply 123 to fan unit 56, 140. The combination of two stage valve 64 and auxiliary valve 194 provide amplifying, time delay action and, if desired, a convenient means of manual operation.

First, since valve 64 need not pass the full volume of water needed by fan units 56, 140 but only enough water to actuate valve 194, it can be made much smaller, and if desired integrated into the lid and seat hinge assemblies themselves. This is highly desirable from the point of view of the user, since it reduces the complexity of the exposed parts so that the toilet is easier to keep clean, i.e., fewer cracks and crevices.

Second, auxiliary valve 194 desirably has a built in shut-off delay, such that valve 194 remains on for a predetermined period after valve 64 closes. This has the advantage of keeping fan unit 56, 140 running for a predetermined period after use of the toilet is complete so as to remove any remaining odors. Means and methods for providing time delayed valve closure are well known in the art. For example, and not intended to be limiting, if valve 194 contains an actuation chamber with a diaphragm which, when pressurized beyond a certain amount by water flowing from valve 64, causes valve 194 to open, then when valve 64 closes this water is trapped therein and the actuation chamber is still under pressure causing valve 194 to remain open. A small pressure relief channel is provided to bleed off the pressure in the actuation chamber at a known rate. Valve 194 remains open until the pressure in the actuation chamber falls below the amount needed to maintain the valve in the open position. The time delay is proportional to the size of the actuation chamber and pressure relief channel, and virtually any desired amount of time delay can be obtained. This feature is highly desirable.

Third, the use of valve 194 makes it very easy to provide a manual over-ride for actuating fan unit 56, 140 since valve 194 is in parallel with valve 64. For example, a small (e.g., slide) valve actuated by button or lever 198 and connected between the water inlet to valve 194 and the valve actuation chamber is included in valve 194. When button 198 is momentarily pushed, pressure is applied to the valve actuation chamber, thereby opening valve 194. Valve 194 stays open until the end of its built in time delay and then closes automatically. The odor removal fan runs while valve 194 is open. A further push of button 198, causes the cycle to repeat. If button 198 is held down, valve 194 remains open and continuous operation of the odor removal fan occurs until the button is released, whereupon the fan stops after the built in valve closure time delay. This is very convenient when a user desires to run the odor removing fan independent of the positions of the lid and seat. For example, when one desires to empty a bed pan, the lid is up and there is no weight on the seat. Ordinarily, the odor removal fan would not run under these circumstances, but it can be actuated manually by use of button 198.

The housings and other elements illustrated in FIGS. 2–15 are conveniently fabricated of metal or plastic or a combination thereof. Plastic is preferred for the housings and struts and metal for the moving parts, such as the rotating shafts and pivots, and for the valve bodies, but this is not essential. It is desirable that the parts resist corrosion. While the use of a two stage valve has been described for controlling the fan unit and automatic gas valve, other means of turning the hydraulic motor on and off and opening and closing the gas valve, may also be employed. And while it is desirable that the hydraulic turbine be driven by a water jet derived from the input water line for the toilet, this is not intended to be the exclusive means of actuating the water motor. For example, advantage may be taken of the water stored in tank 40 by, for example, by placing a water turbine in or under inlet 42 so that it is turned by inrushing water 64 when the toilet is flushed. This gravity fed water turbine may be coupled directly to an air circulator or indirectly by a belt or simple gear or chain mechanism. Rubber is a suitable belt material and the gears or chain are conveniently made of plastic for resistance to corrosion. This arrangement is particularly attractive where very little water pressure is available and the force of the water falling by gravity into the toilet is greater.

Having thus described the invention, it will be apparent to those of skill in the art, that the present invention provides for positive ventilation of toilets without the need for any electrical connections to drive fans or operate valves or other elements. This is a significant safety and convenience feature. The present invention provides a hydraulically driven fan that is automatically turned on and off when the toilet is used without the need for any action on the part of the user. In addition a gas valve is provided that shuts off the ventilation channel so that back-streaming of sewer gas into the toilet is avoided. A further feature of the present invention is that the automatic positive ventilation and automatic anti-back-streaming valve arrangement may be contained within a housing that drops into a cavity in the toilet without the need for attaching water lines or electrical lines to the toilet itself or for high precision mating surfaces on the toilet base. This is a great convenience since most toilets are cast from ceramic and it is difficult or unduly expensive to provide high precision surfaces or threaded holes or embedded pressurized plumbing lines.

Another advantage of the present invention is that the fan and valve assembly is self-draining, and self flushing, that is, the operation of the water turbine flushes out the fan and gas valve assemble each time it is used, and any residual water automatically drains away into the sewer. A further advantage of the present invention is that the fan unit, water control valves and gas valve may be easily removed for cleaning or repair or replacement without removing the toilet itself. This is a great convenience since it is not unusual to have toilets remain in place and in use for many decades. A still further advantage of the present invention is that operation of the odor removing fan unit may be maintained for a predetermined period after use of the toilet is completed. Yet another advantage is that a manual over-ride is easily provided for actuating the odor removing fan under any circumstances and without having to sit upon the toilet.

Persons of skill in the art will further understand based on the description herein that although the present invention has been described in terms of certain exemplary arrangements, that many variations and substitutions are possible as will occur to those of skill in the art based on the teachings herein, and that it is intended to include these within the scope of the claims that follow.

What is claimed is:

1. An odor removing toilet comprising:

a bowl for receiving wastes and discharging said wastes to a sewer connection when said toilet is flushed;

a toilet seat and a toilet lid coupled to said toilet;

a water supply connection coupled to said toilet for providing water to discharge said wastes;

a water driven motor;

a fan having a intake coupled to said bowl and a discharge coupled to a vent, said fan being powered by said water driven motor; and a valve coupled between said water supply and said water driven motor for controlling admission of water to said water driven motor, and means coupled between said toilet seat, toilet lid, and valve, whereby said valve admits water to said water motor only when said lid is in a raised position and said seat is in a lowered position and weight is applied on said toilet seat.

2. The toilet of claim 1 wherein said valve comprises two series connected portions, a first portion actuated by said lid and a second portion actuated by said seat

3. The toilet of claim 2 wherein said first portion is moved into a position allowing water flow when said lid is raised and said second portion is moved into a position allowing water flow when said seat is in a lowered position and weight is applied to said seat.

4. The toilet of claim 3 wherein said first and second portions comprise rotary valves.

5. The toilet of claim 1 wherein said toilet comprises a passageway leading from an upper region of said bowl to a channel communicating with said sewer connection and wherein said fan is located in said passageway and said passageway also communicates with a water reservoir used for providing water to flush said toilet.

6. The toilet of claim 5 further comprising a multi-bladed butterfly valve interposed in said passageway for closing said passage when said toilet is not in use.

7. The toilet of claim 6 wherein said multi-bladed butterfly valve is integral with said fan.

8. The toilet of claim 5 further comprising a gas blocking valve located in said passageway, wherein said gas blocking valve is a normally closed valve interposed between said upper region of said bowl and said water motor, wherein said gas blocking valve comprises a cup which fills with water when said toilet is flushed, thereby overbalancing and opening said valve, wherein said cup comprises a drain allowing the water to escape therefrom after the toilet has been flushed so that, when the weight of the water is removed from said cup, said gas blocking valve returns to said closed position.

9. The toilet of claim 8 further comprising time delay shut-off means for maintaining the water supply to the fan for a predetermined time after use of the toilet is complete.

10. An odor removing toilet having a lid and seat, comprising:

a first portion having a sewer connection and a bowl for receiving wastes, said lid and seat connected to said bowl;

a second portion for storing water used for flushing;

first channel means in the first portion communicating between the bowl and a water inlet for receiving water from the second portion for flushing waste from the bowl;

second channel means in the first portion communicating between the bowl and the sewer connection for conveying water and waste from the bowl to the sewer connection;

third channel means in the first portion communicating between the first channel means and the second channel means;

water driven fan means located in the third channel means for removing odor bearing gasses from the bowl in part through the first channel means; and valve means coupled to said lid and seat for operatively controlling said water driven fan means, wherein said valve means admits water to said water driven fan means only when said lid is in a raised position and said seat is in a lowered position, and weight is applied to said seat.

11. The toilet of claim 10 further comprising an anti-backstreaming gas valve for closing the third channel means when the toilet is not in use, said gas valve comprising a multi-bladed butterfly valve.

12. The toilet of claim 11 wherein said gas valve is integral with said fan means.

13. The toilet of claim 11 wherein said gas valve is balanced so as to be normally closed and is opened when said toilet flushes by water entering a chamber attached to the valve wherein the weight of the water alters the balance of the gas valve causing it to swing open by gravity.

14. The toilet of claim 13 wherein the chamber has therein a drain opening through which the water entering the chamber drains away after flushing is complete, returning the chamber to its pre-flushing condition so that the gas valve swings shut by gravity.

15. An odor removing mechanism for use in toilets, wherein said toilets include a lid and seat coupled to a toilet bowl, said mechanism, comprising:

a water motor;

a fan coupled to the water motor for pumping gases from an inlet to an outlet of the mechanism; and a valve coupled to the water motor for admitting water thereto, said valve having two separately actuated series coupled portions, the first portion being actuated by said toilet lid and the second portion by said toilet seat, so that water can flow through both portions only when the lid is open and the seat is in a lowered position and has weight applied thereto.

16. The mechanism of claim 15 further comprising a gas valve for preventing back-streaming gases passing in the outlet and out the inlet when the fan is not running, said gas valve comprising a multi-bladed butterfly valve.

17. The mechanism of claim 16 wherein said gas valve is integral with said fan.

18. The mechanism of claim 15 further comprising a gas valve for preventing back-streaming gases passing in the outlet and out the inlet when the fan is not running, wherein said gas valve is balanced so as to be held in a normally closed position by gravity and wherein said gas valve further comprises a reservoir coupled thereto which fills when said toilet is flushed, the weight of water contained therein changing the balance of said gas valve causing said gas valve to open by gravity, and wherein said reservoir automatically empties when said flushing is complete, thereby removing the weight of said water in said reservoir so that said gas valve returns automatically to said closed position.

* * * * *